United States Patent [19]

Cook

[11] Patent Number: 4,773,535

[45] Date of Patent: Sep. 27, 1988

[54] PORTABLE TOOL CASE

[76] Inventor: Ralph E. Cook, 610 E. 150 S., Pleasant Grove, Utah 84602

[21] Appl. No.: 96,063

[22] Filed: Sep. 14, 1987

[51] Int. Cl.[4] ..... B65D 85/00; B65D 33/06

[52] U.S. Cl. ..... 206/373; 383/11; 383/38; 383/39

[58] Field of Search ..... 206/372, 373; 383/38, 383/39, 40, 11

[56] References Cited

U.S. PATENT DOCUMENTS

| | | | |
|---|---|---|---|
| 1,094,009 | 4/1914 | Parkhurst | 206/373 |
| 2,405,517 | 8/1946 | Plummer | 383/39 X |
| 2,533,725 | 12/1950 | Eisenberg | 383/40 X |
| 3,086,572 | 4/1963 | Lubin | 383/39 X |
| 3,549,064 | 12/1970 | Wilson | 206/373 X |
| 3,967,666 | 7/1976 | Farrar | 383/39 X |
| 4,241,833 | 12/1980 | Luebcke | 206/373 |
| 4,263,951 | 4/1981 | Siegel | 150/113 X |
| 4,416,372 | 11/1983 | Polk | 206/372 |
| 4,662,517 | 5/1987 | Wirth | 383/38 X |

FOREIGN PATENT DOCUMENTS

| | | | |
|---|---|---|---|
| 103974 | 2/1917 | United Kingdom | 206/373 |

*Primary Examiner*—William Price

*Attorney, Agent, or Firm*—J. David Nelson; Michael D. McCully

[57] ABSTRACT

A portable tool case has at least two canvas panels attached together. Each panel includes at least one, and preferably a plurality of, tool holding pockets, each pocket for holding a single tool. In one embodiment, two panels are hingedly attached together along a mating edge such that the case can be draped over a sawhorse, protective railing, etc., a panel hanging on each side of the sawhorse. The tool holding pockets are located on the exterior surfaces of the panels, as the case rests on the sawhorse, and support tools of a particular trade in fully exposed and easily accessible manner. The two panels may be attached together and the case easily transported by hand by a handle located on the hinged attachment of the two panels.

A second embodiment resembles a portfolio or attache case. The two panels comprising the tool case have the plurality of tool holding pockets on the interior sides of the panels, such that the tools can be enclosed when the case is folded over and closed.

A third embodiment encloses a top horizontal panel and four vertical panels defining an open-bottom boxlike device. This embodiment is adapted to fit down over, and be supported on top of, a stepladder. Three or more of the vertical panels each include at least one tool holding pocket. This embodiment, fully loaded with tools, may be easily carried about by the handle on the top panel.

2 Claims, 2 Drawing Sheets

PORTABLE TOOL CASE

BACKGROUND OF THE INVENTION

1. Field of the Invention

This invention relates to manually transportable pouches or cases for carrying various items, and more particularly relates to portable cases having individualized pockets therein for receiving and carrying a trademan's tools, such cases also being adapted to be draped over, or otherwise supported by, a supporting device, to thereby position the tools for easy access.

2. Prior Art

Many devices have been patented for carrying various items in saddle bags that convert to bags, cases, or satchels for carrying by hand. Their common purpose, of course, was to transport such items in a saddle bag that was easily convertible to a satchel which could be carried by hand. These convertible saddle bags were generally designed for transporting certain classes of items—physicians' supplies, medicine bottles, etc.

In the area of tradesman's tools, portable tool boxes are used for transporting tools about. Once at the job site, however, the tradesman must (1) carry his tool box around with him and rummage through it when seaching for a specific tool, (2) lay all of his tools on the floor around him so that they will be relatively accessible when he needs specific tools, or (3) wear a tool belt adapted to hold a certain number of tools.

The tradesman's options each have drawbacks. Some of these drawbacks are quite serious, and even dangerous. For instance, the worker in a high-rise building framework cannot lay his tools on the temporary floors of the high-rise building for the obvious reason that he could easily step on one, turning his ankle, causing him to lose his footing and possibly fall from the framework. Additionally, tools laid on temporary high-rise floors could easily be kicked off, to the serious injury of persons working below.

Similar problems are present in the high-rise building window washing profession. Dropped tools can be extremely dangerous to the general public below.

Other problems, although not as serious as those associated with high-rise building construction and maintenance, are more of inconvenience. For example, a drywall finisher's tools are generally too large to be carried on a tool belt. He therefore must lay the larger ones on the floor close to his work area, where they could be stepped on and deformed or otherwise cause him to trip.

Certain tradesmen (e.g., auto mechanics) store and use tools from a generally large and upright tool box on casters that can be rolled around. Such tool boxes are generally big and bulky and are totally impractical for many trades, e.g., carpenters, drywall installers, drywall finishers, high-rise building window washers, high-rise building construction workers, to name but a few.

It is therefore an object of the present invention to provide a portable tool case that may be used virtually anywhere, including high-rise building construction sites.

It is another object of the present invention to provide a portable tool case that displays all of the needed tools used in a particular trade in readily graspable and removeable orientation.

It is an additional object of the present invention to provide a portable tool case that is easily located adjacent a trademan's work area.

It is a further object of the present invention to provide a portable tool case that holds all of the needed tools used in a particular trade in individual pockets.

It is an additional object of the present invention to provide a portable tool case that is lightweight and easily transportable.

SUMMARY OF THE INVENTION

These and other objects and advantages are realized by a portable tool case comprising at least two panels attached together along similar mating edges thereof. At lease one the panels is formed with a tool supporting surface defined by a plurality of tool holding pockets, each pocket for holding a single tool of a variety of tools used in a specific trade.

In one embodiment, the tool case is adapted to be folded together at the attachment of the panels, for ease of carrying. The tool supporting surface is formed on the exterior side(s) of the panel(s) (as defined by the direction the panels are folded together). Such embodiment is intended to be draped over a support structure, as in a sawhorse, a scaffolding railing, a ladder, etc., so that the tools are exposed and readily accessible to the tradesman as he works. In another embodiment, the tool case is also adapted to be folded together. However, in this embodiment, the tool supporting surfaces are formed on the interior sides of the panels, so that the tool case may be folded close and carried about like a portfolio or attache case and opened like a book for access to the tools inside. In a third embodiment, an open-bottom boxlike tool case has three or four tool supporting surfaces formed on the exterior sides of the vertical panels, the top horizontal panel serving to support the vertical panels. This embodiment is adapted to rest over an open stepladder to position the tradesman's tools conveniently atop the ladder. In each embodiment, the tool cases are fully portable and lightweight, being made of canvas, and carry all of the tools peculiar to a particular trade in individual pockets in fully supportable and easily graspable and removeable manner.

Other objects and features of the invention will become apparent from the following detailed description and drawings disclosing what is presently contemplated as being the best mode of the invention.

IN THE DRAWINGS

DETAILED DESCRIPTION OF THE INVENTION

Figure 1:
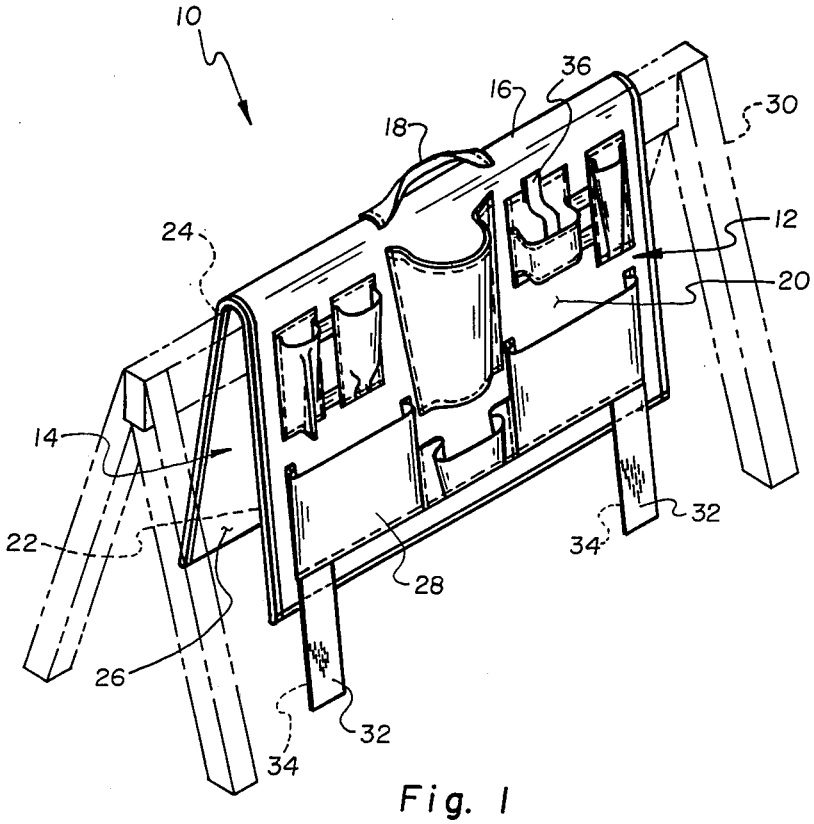
FIG. 1 is a perspective view of a first embodiment of the tool case of the present invention.

Turning now to the drawings, and initially to FIG. 1, a first embodiment of the portable tool case of the present invention is shown, generally illustrated by the numeral 10. This particular embodiment is formed of a first panel 12 and a second panel 14. Preferably, the two panels 12, 14 ar formed of two sheets of canvas with a sheet of stiffening material—cardboard, leather, a dense foam rubber, etc—(not shown) between, in order to increase the structural stiffness of the tool case. The two canvas sheets are sewn together around their mating peripheral edges to result in the two panels. The two panels can then be folded together, as shown in FIG. 1, to define a flexible hinge section 16.

Instead of a single sheet of stiffening material, the tool case of FIG. 1 can be made using two sheets, each the size of the panels 12, 14. This design permits the tool case to be folded more easily at the flexible hinge 16 due to the void of stiffening material along the hinge.

As a second construction alternative, the two panels 12, 14 may be made separately, each including a sheet of stiffening material, and the two sewn together or to a length of webbing material comprising the flexible hinge 16 along mating lengthwise edges of each panel. In each construction, a handle 18 is securely attached to the attachment portion of the tool case defining the hinge 16.

As shown, the first panel 12 includes a tool supporting surface 20 which forms the exterior surface of the first panel. As defined by the direction in which the hinge 16 flexes and the panels 12, 14 face each other, the first panel also has an interior surface 22. The second panel 14 also has an exterior tool supporting surface 24 and an interior surface 26. Each of these tool supporting surfaces 20, 24 is formed with a plurality of tool holding pockets 28, also made of canvas and sewn to at least the exterior canvas layer defining the panel.

The portable tool case of the present invention is designed to accommodate all of the tools generally required in a particular trade. For example, a drywall installer generally uses the following tools - hammer, tape measure, pencil, knife, keyhole saw, hammering block, lift (a falcrum device for lifting and retaining a vertical sheet of drywall into position prior to nailing or screwing same onto the wall studs). The drywall installer requires all of these tools at different stages of installation, many of them repeatedly and frequently. It is impossible, however, for the drywall installer to carry each of these tools in a tool belt for ready access. It is also very impractical for the installer to simply leave most of these tools lying about on the floor around his work area, both for reasons of efficiency in locating and retrieving the tools as needed, and for reasons of safety-tools left lying around on the floor are easily stepped on and/or tripped over. Therefore, the portable tool case is designed to hold each of the tools of a particular trade in individual holding pockets 28 that are sized for a specific tool. The portable tool case illustrated in FIG. 1, for instance, is designed to accommodate the tools generally used in installing drywall. Therefore, the various tool holding pockets 28 are sized to hold individually the specific drywall installer's tools listed above.

The first embodiment of the portable tool case shown in FIG. 1 is adapted to be supported in a generally upright orientation by draping the case over a support device, as in sawhorse 30, shown in phantom lines. By so draping and supporting the tool case, the tradesman's tools are always together in one place and readily accessible for use.

Although not shown in FIG. 1, the tool supporting surface 24 on the exterior of the second panel 14 also includes a plurality of tool holding pockets. This second set of pockets may be adapted to hold additional drywall installer's tools, or may be designed specifically to hold tools of a different, but possibly related, trade. For instance, the second set of pockets may be designed to hold drywall finishing tools—hammer, knife, one or more rolls of tape, towel, putty knife, sanding block(s), etc. In this manner, the tradesman engaged in both trades—drywall installation and drywall finishing—may carry all of his tools for each trade in a single tool case that displays each tool readily accessible in individual tool pockets.

Referring again to FIG. 1, the first embodiment of the portable tool case includes a pair of attacment devices in the form of reinforced canvas or webbing tabs 32. These attachment tabs 32 include a section of hook and loop fastening material 34 on the side facing the second panel 14, as shown. Mating sections of hook and loop fastening material are attached to the exterior tool supporting surface 24 of the second panel, at the locations where the attachment tabs 32 will fold around the bottom edges of both panels. The attachment tabs 32 and mating fastening material sections function to hold the two tool case panels together while the case is being hand-carried or otherwise transported around. Attaching the two panels together greatly improves the stability of the tool case for both hand-carrying and for pitching the filled tool case into the back of a truck, for instance. Additionally, the two panels may be attached together while the tool case is draped over a sawhorse, for instance, although this is generally not necessary to hold the tool case in place.

Because the portable tool case is intended to be carried about in the back of a truck, for instance, with all of the tools intact, it may be preferable to strap some loose-fitting tools into their pockets. Therefore, some of the tool pockets 28 include lock straps 36 for preventing certain tools from falling out of the pockets while the tool case is riding, generally always horizontally, in the back of a work truck. These lock straps 36 also include hook and loop fastener material for easy opening and closing.

Figure 2:
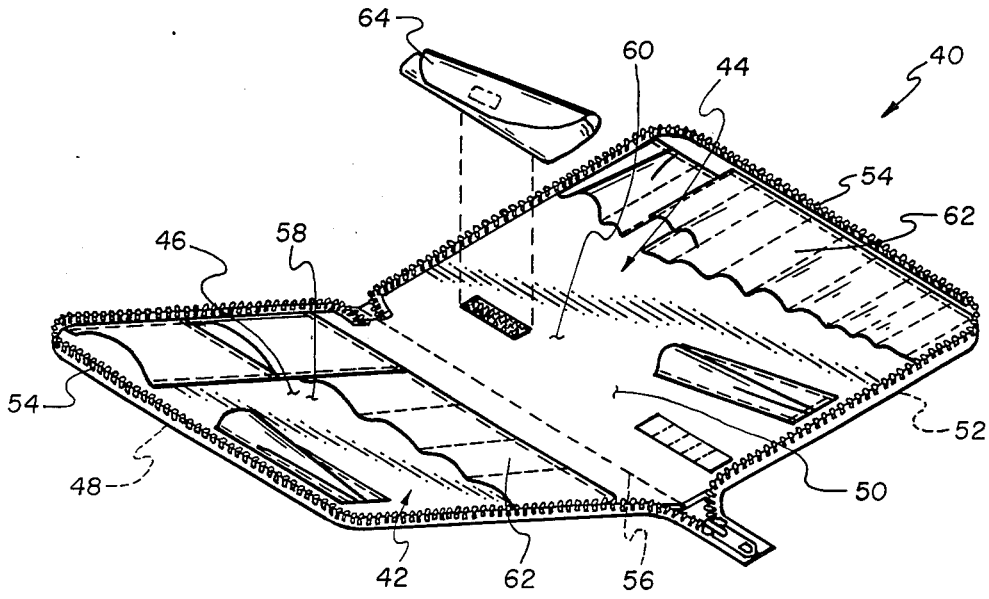
FIG. 2 is a perspective view of a second embodiment of the tool case of the present invention.

Turning now to FIG. 2, a second embodiment of the portable tool case of the present invention is shown, generally illustrated by the numeral 40. As in the first embodiment of FIG. 1, this second embodiment is formed of a first panel 42 and a second panel 44 joined in a flexible hinge 56 along mating lengthwise edges of each panel. Also as in the first embodiment, each panel of the second embodiment 40 is formed of at least two sheets of canvas sewn together around the peripheral edges thereof to define the first and second panels. The first panel 42 has an interior side 46 and an exterior side 48; similarly, the second panel 44 has an interior side 50 and an exterior side 52. The preferred construction of this embodiment is to sandwich a panel of stiffening material (not shown) between the two large canvas sheets that comprise both interior sides 46, 50 and both exterior sides 48, 52, and sew the two sheets together at their peripheral edges. At this point in construction, a zipper closure member 54 preferably is sewn in with the peripheral edges. The sandwiched stiffening material may be a single uniform piece, or a single piece having a score or weakened section transversely across the piece to define a flexible hinge 56. Alternatively, the stiffening material may take the form of two individual pieces, one each sandwiched between the canvas sheets to form individual panels 42 and 44, the hinge 56 being defined by the void of stiffening material between the two panels. This embodiment may also be formed sandwiching a panel of stiffening material between the two canvas sheets of each panel 42, 44, and the two panels then attached together at the flexible hinge 56 along mating lengthwise edges of each panel. This hinge 56 may be constructed of a reinforced canvas or webbing material.

This second embodiment of FIG. 2 includes a first tool supporting surface 58 formed on the interior side 46 of the first panel, and a second tool supporting surface 60 formed on the interior side 50 of the second panel, as defined by the inward direction in which panels fold together. Each of these tool supporting surfaces is formed with a plurality of tool holding pockets 63, also made of canvas and sewn to the canvas sheet defining the interior sides 46, 50. This embodiment, by holding the various tools on the inside of the case when folded, can be carried like an attache case or portfolio.

The tool case shown in FIG. 2 is adapted to accommodate a standard set of open-end wrenches, a set of screwdrivers and/or nutdrivers of conventional sizes, and a rachet and socket set. In order to make the set of sockets more accessible, a detachable pocket 64 is provided which is sized to hold the set. The detachable pocket is closable and is removably attachable to the tool supporting surface 60 by a hook and loop fastening mechanism.

As in the first embodiment, the tool case of FIG. 2 is designed to accommodate all of the tools of a particular trade. For example, an office machine serviceman would typically use this particular design of tool case because of its compact size and because of the improved aesthetics of the exterior, due to the tools being held inside the closed case. Additionally, of course, this attache case design is appealable to the general public, for instance, to be carried in a vehicle, conveniently under the seat or in the trunk, as a readily accessible mobile tool kit.

Figure 3:
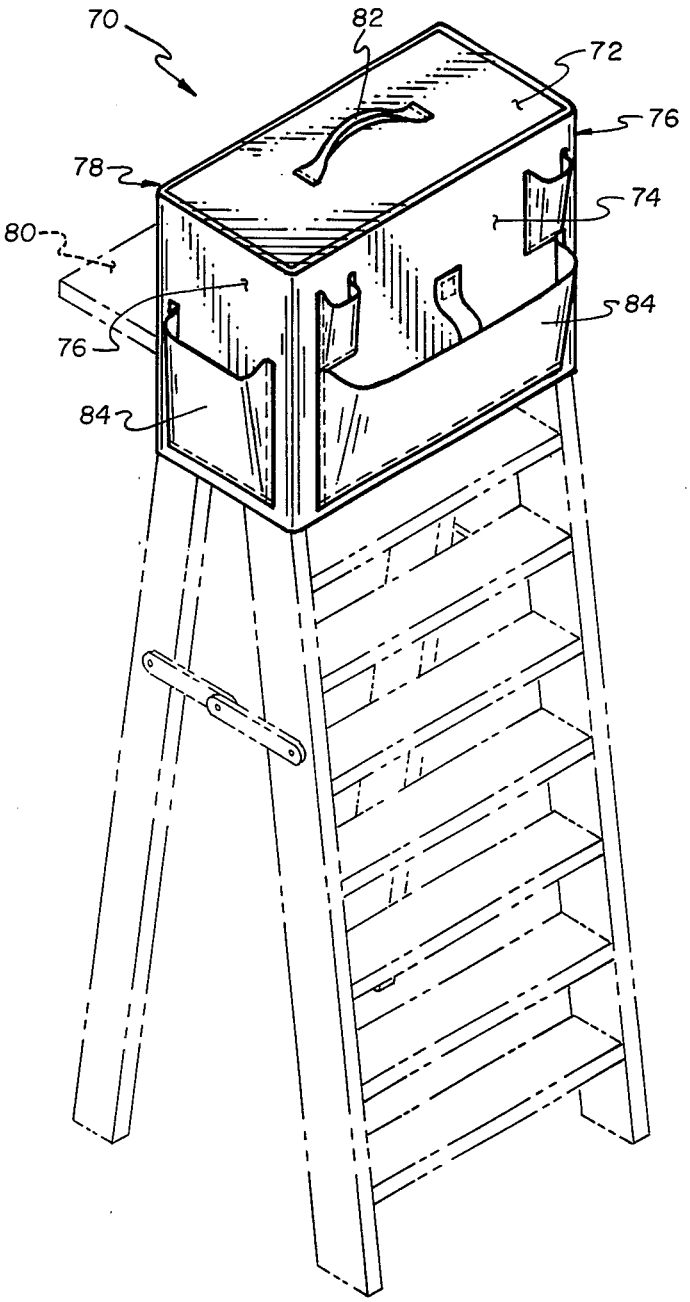
FIG. 3 is a perspective view of a third embodiment of the tool case of the present invention.

Turning now to FIG. 3, a third embodiment of the portable tool case is shown at 70. This embodiment does not fold for easy carrying, as in the previous two embodiments, although it, too, is constructed of a plurality of canvas panels. As shown, a top panel 72 is intended to be positioned horizontally atop a stepladder, and supports a front panel 74, side panels 76, and a rear panel 78, all in general vertical orientation. As can be appreciated, the rear panel 78 does not necessarily extend downwardly as far as the other vertical panels, its length being restricted by the fold down shelf 80 of the stepladder.

In this particular embodiment, the top panel 72, being more of a structural panel than the vertical panels, is constructed in similar fashion to the panels of the previous embodiments, inasmuch as the top panel comprises exterior and interior layers or sheets of canvas, and a sheet of stiffening material sandwiched between them. Such a construction provides improved structural integrity to maintain its general boxlike configuration when fully loaded with tools and carried about by the centrally located handle 82.

The four vertical panels 74, 76, 76, 78, are sewn to mating edges of the top panel to define the boxlike configuration. These vertical panels are generally constructed of one or two layers of canvas sew together, without any stiffening material sandwiched between, although it would certainly be possible and appropriate to do so if desired.

In this embodiment, the exterior of sides of the front and side panels 74, 76, 76, define tool supporting surfaces. Each of these tool supporting surfaces is formed with at least one tool holding pocket 84, also made of canvas and sewn to at least the exterior canvas layer defining the panel. The tool holding pockets of this embodiment may be sized to hold individual tools, as in the previous embodiment, but also may be considerably larger, as shown, for holding a plurality of smaller tools.

This particular design is adapted for use by A/C and ventilation ductwork installers, electricians installing overhead lighting, ceiling installers, and generally anyone working from a stepladder and requiring a larger selection of tools within reach than the stepladder shelf 80 can accomodate.

From the foregoing it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A tool case for holding and manually transporting a plurality of tradesman's tools, and for draping over a scaffolding rail, a sawhorse, or the like, in a manner to provide said tradesman with ready access to each of said tools, said tool case comprising:

a first panel comprising first and second sheets of cloth material sandwiched about a stiffening sheet of plastic, cardboard or the like, said first panel defining an exterior tool supporting surface having a plurality of vertically oriented, top-opening pockets formed therewith, each of said pockets sized to receive therein one of said tools in fully supportable and easily graspable, removable, and replaceable manner;

a second panel comprising first and second sheets of cloth material sandwiched about a stiffening sheet of plastic, cardboard or the like, said first panel defining an exterior tool supporting surface having a plurality of vertically oriented, top-opening pockets formed therewith, each of said pockets sized to receive therein one of said tools in fully supportable and easily graspable, removable, and replaceable manner;

a flexible intermediate hinge member hingedly connecting said first and second panels together along adjacent edges thereof;

a pair of hook and loop attachment members attached to said first and second panels for removably attaching said first and second panels together; and a handle attached to said hinge member. pg,15

2. A tool case according to claim 2, wherein said tool case is made from a canvas material.

* * * * *

UNITED STATES PATENT AND TRADEMARK OFFICE

CERTIFICATE OF CORRECTION

PATENT NO. : 4,773,535

DATED September 27, 1988

INVENTOR(S) : Ralph E. Cook

It is certified that error appears in the above-identified patent and that said Letters Patent is hereby corrected as shown below:

In column 1, line 10, "trade-" should be --trades---;

In column 2, line 64, "ar" should be --are--;

In column 3, line 68, "towel" should be --trowel--;

In column 5, line 59, "sew" should be --sewn--;

In column 6, line 59 delete "pg, 15"; and

In column 6, line 60, "2" should be --1--.

Signed and Sealed this

Seventh Day of March, 1989

*Attest:*

DONALD J. QUIGG

*Attesting Officer*

*Commissioner of Patents and Trademarks*